US009947998B2

(12) United States Patent
Hsiao

(10) Patent No.: US 9,947,998 B2
(45) Date of Patent: Apr. 17, 2018

(54) LAMINATED ANTENNA

(71) Applicant: ADVANCED-CONNECTEK INC., New Taipei (TW)

(72) Inventor: Fu-Ren Hsiao, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 48 days.

(21) Appl. No.: 15/349,485

(22) Filed: Nov. 11, 2016

(65) Prior Publication Data

US 2017/0194700 A1 Jul. 6, 2017

(30) Foreign Application Priority Data

Dec. 30, 2015 (TW) ..... 104144556 A

(51) Int. Cl.

| | |
|---|---|
| ***H01Q 1/36*** | (2006.01) |
| ***H01Q 1/24*** | (2006.01) |
| ***H01Q 1/48*** | (2006.01) |
| ***H01Q 9/04*** | (2006.01) |
| ***H01Q 9/42*** | (2006.01) |
| ***H01Q 5/364*** | (2015.01) |

(52) U.S. Cl.

CPC ..... *H01Q 1/36* (2013.01); *H01Q 1/24* (2013.01); *H01Q 1/48* (2013.01); *H01Q 5/364* (2015.01); *H01Q 9/0485* (2013.01); *H01Q 9/42* (2013.01)

(58) Field of Classification Search

CPC ..... H01Q 5/364; H01Q 9/045; H01Q 9/42; H01Q 1/48; H01Q 1/24

See application file for complete search history.

(56) References Cited

U.S. PATENT DOCUMENTS

| | | | |
|---|---|---|---|
| 7,012,568 | B2 | 3/2006 | Poilasne et al. |
| 8,547,283 | B2 | 10/2013 | Wong et al. |
| 2006/0017621 | A1 | 1/2006 | Okawara et al. |

(Continued)

FOREIGN PATENT DOCUMENTS

| | | |
|---|---|---|
| TW | 200840136 | 10/2008 |
| TW | 201203703 | 1/2012 |

OTHER PUBLICATIONS

Office action issued in corresponding Taiwan patent application 10620302540 dated Mar. 20, 2017, 5 pages.

*Primary Examiner* — Hoang Nguyen

(74) *Attorney, Agent, or Firm* — Andrew M. Calderon; Roberts Mlotkowski Safran Cole & Calderon, P.C.

(57) ABSTRACT

A laminated antenna includes a bases board having a grounding port and a feed-in port, a feed-in portion on the base board, a dielectric layer, a conductive layer, and a second winding portion. The feed-in portion has opposite first and second ends. The first end is connected to the feed-in port. The dielectric layer has a covering surface covering the feed-in portion and an assembling surface. The conductive layer is on the assembling surface. The conductive layer includes a main radiation portion, an extension radiation portion, and a first winding portion. A segment of the main radiation portion is overlapped with the second end to form a coupling capacitor. The first winding portion is extending between the main radiation portion and the extension radiation portion to form a first inductor. The second winding portion is connected between the main radiation portion and the grounding port to form a second inductor.

13 Claims, 9 Drawing Sheets

(56) References Cited

U.S. PATENT DOCUMENTS

| | | | | |
|---|---|---|---|---|
| 2009/0273530 | A1 | 11/2009 | Chi et al. | |
| 2011/0122027 | A1* | 5/2011 | Wong | H01Q 1/243 343/700 MS |
| 2015/0054708 | A1* | 2/2015 | Lin | H01Q 5/371 343/846 |

* cited by examiner

LAMINATED ANTENNA

CROSS-REFERENCE TO RELATED APPLICATION

This non-provisional application claims priority under 35 U.S.C. § 119(a) to Patent Application No. 104144556 in Taiwan, R.O.C. on Dec. 30, 2015, the entire contents of which are hereby incorporated by reference.

FIELD OF THE INVENTION

The instant disclosure relates to an antenna, and more particular to a laminated antenna.

BACKGROUND

Recently, along with the flourishing developments of the communication devices, needs for antennas installed to the communication devices increase. In addition, the developments of communication devices become diverse, so do the antennas.

U.S. Pat. No. 8,547,283 recites a multiband antenna and method for an antenna to be capable of multiband operation. Please refer to FIG. 1. The multiband antenna 90 includes a first metal portion 91, a second metal portion 92, and a third metal portion 93. A capacitively-coupled portion 94 is formed between the first metal portion 91 and the second metal portion 92, and an inductively-coupled portion 95 is connected between the second metal portion 92 and the third metal portion 93. The first metal portion 91 and the second metal portion 92 enable the multiband antenna 90 to generate a first operating band. The first metal portion 91, the second metal portion 92, and the third metal portion 93 enable the multiband antenna 90 to generate a second operating band.

However, the first metal portion 91, the second metal portion 92, and the third metal portion 93 of the multiband antenna 90 are respectively disposed on the same substrate. As a result, the value of the capacitively-coupled portion 94 and the value of the inductively-coupled portion 95 are restricted, and the antenna bandwidth is restricted.

SUMMARY OF THE INVENTION

In view of this, an embodiment of the instant disclosure provides a laminated antenna. The laminated antenna comprises a bases board, a feed-in portion, a dielectric layer, a conductive layer, and a second winding portion. The base board has a grounding port and a feed-in port. The feed-in portion is on the base board. The feed-in portion has a first end and a second end opposite to the first end. The first end of the feed-in portion is connected to the feed-in port. The dielectric layer covers the feed-in portion. The dielectric layer has a covering surface and an assembling surface opposite to the covering surface. The covering surface is near to the feed-in portion, and the assembling surface is distant from the feed-in portion. The conductive layer is on the assembling surface of the dielectric layer. The conductive layer comprises a main radiation portion, an extension radiation portion, and a first winding portion. A segment of the main radiation portion is overlapped with the second end of the feed-in portion to form a coupling capacitor. The first winding portion is extending between the main radiation portion and the extension radiation portion to form a first inductor. The second winding portion is connected between the main radiation portion and the grounding port to form a second inductor.

Based on the above, the laminated structures of the dielectric layer, the conductive layer, and the feed-in portion of the laminated antenna allow the coupling capacitor to be formed between the conductive layer and the feed-in portion. In addition, the first inductor and the second inductor respectively formed by the first winding portion and the second winding portion can be interacted with the coupling capacitor to produce at least two bandwidths for communication. Moreover, as compared with the conventional, the laminated antenna can provide wider ranges of the bandwidths.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
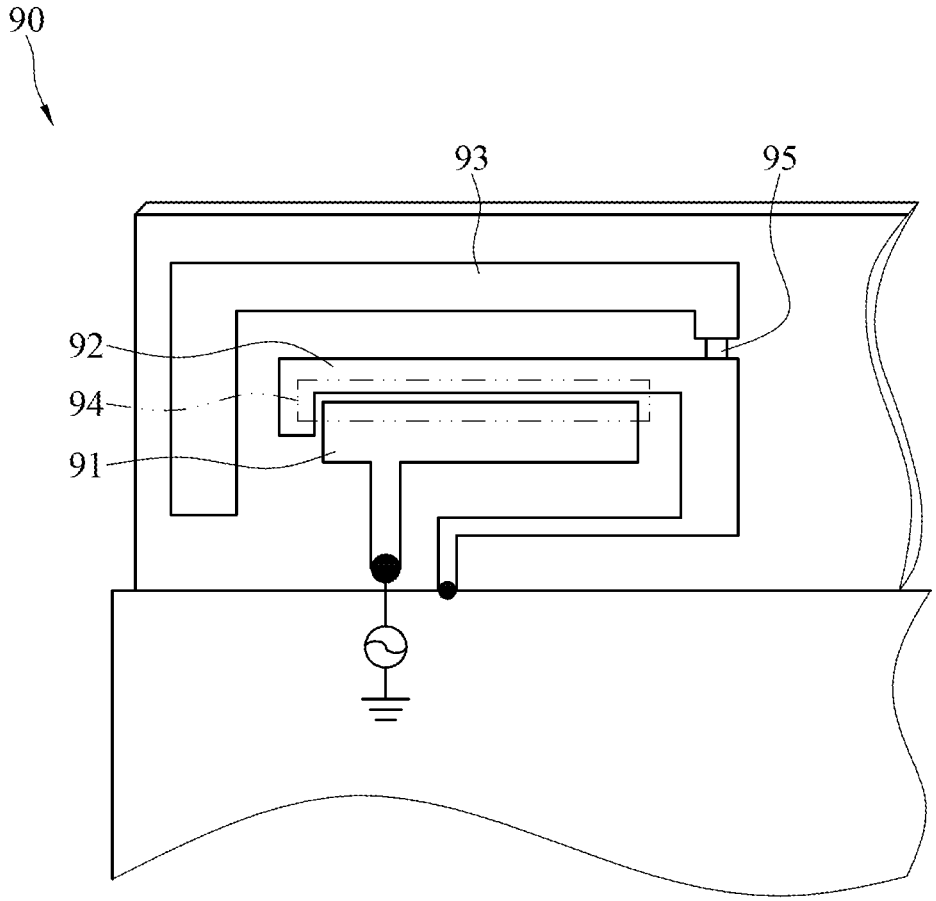
FIG.1 (PRIOR ART)
FIG. 1 illustrates a schematic plan view of a conventional antenna.
Figure 2:
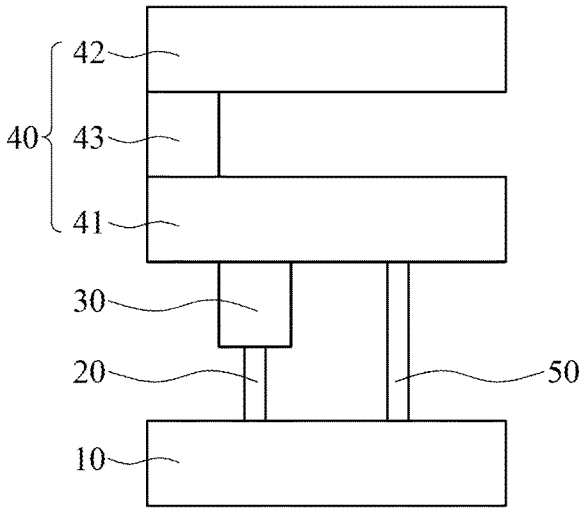
FIG. 2 illustrates a sectional view of a laminated antenna according to a first embodiment of the instant disclosure.
Figure 3:
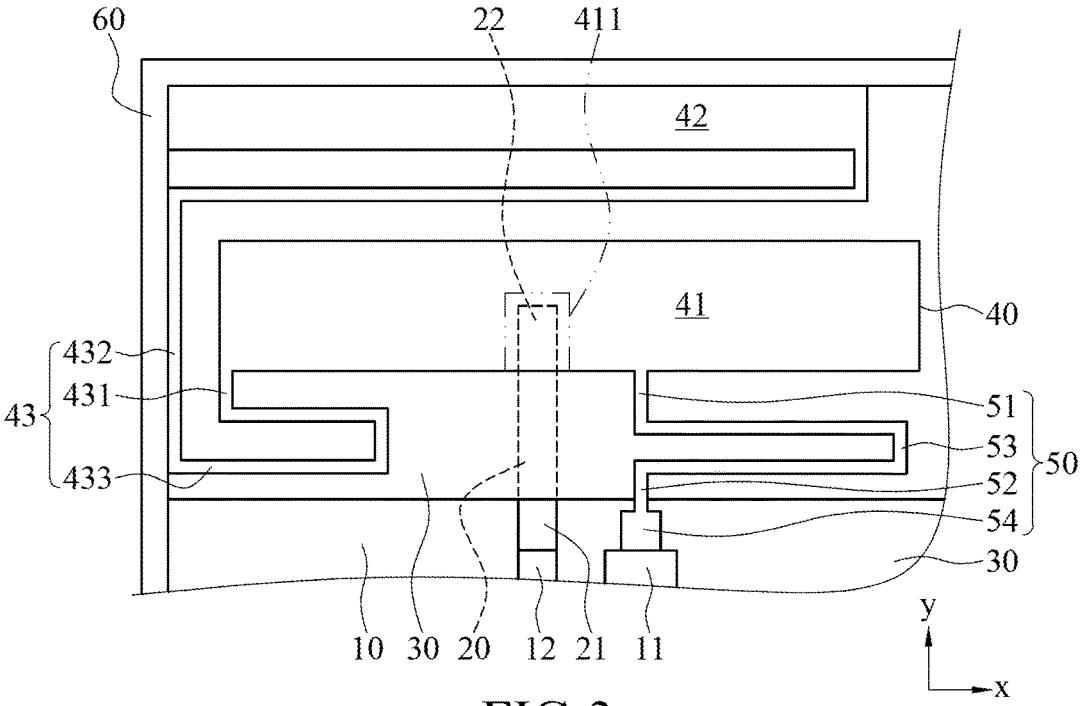
FIG. 3 illustrates a top view of the laminated antenna of the first embodiment.
Figure 4:
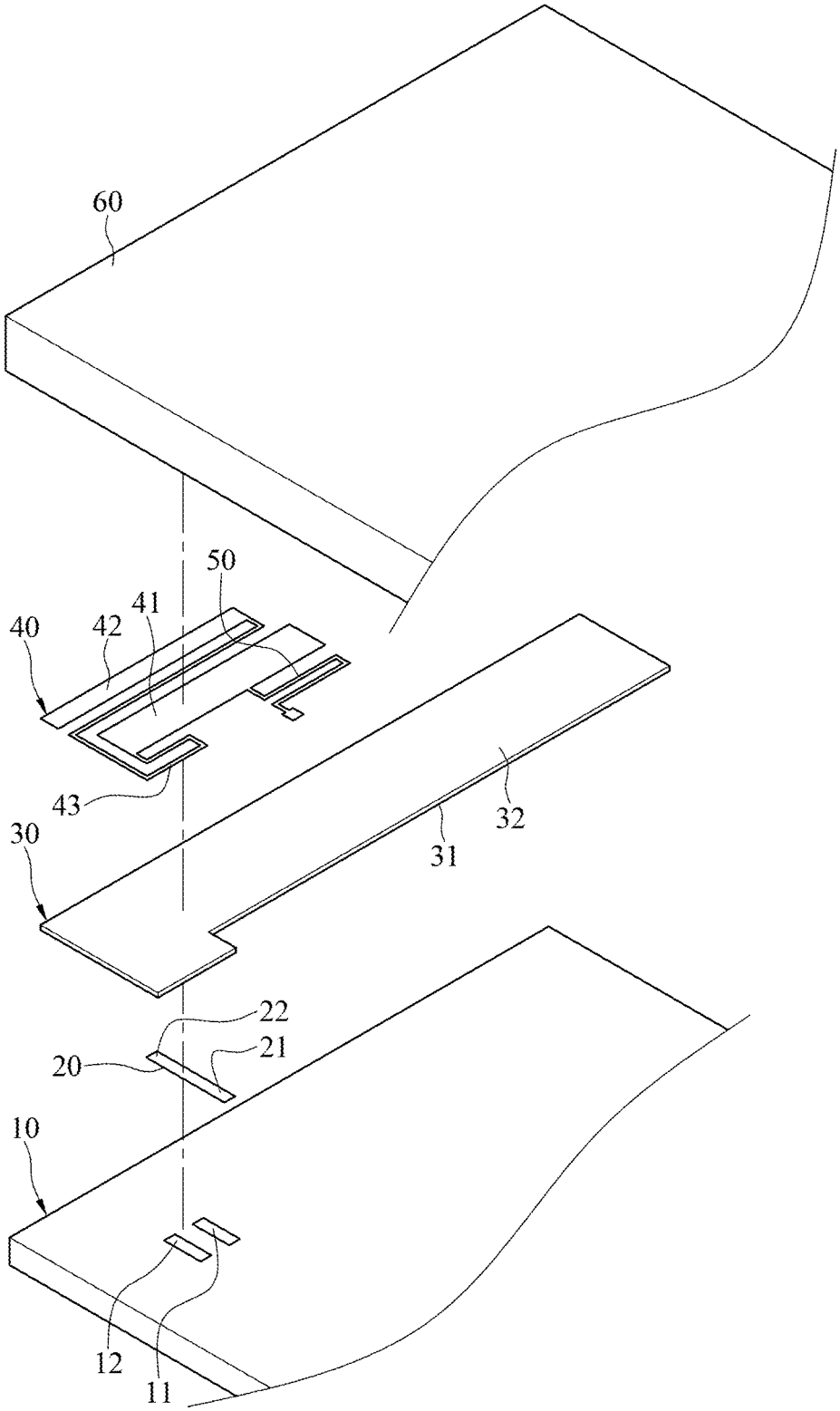
FIG. 4 illustrates an exploded view of the laminated antenna of the first embodiment.

FIG. 2 illustrates a sectional view of a laminated antenna according to a first embodiment of the instant disclosure. FIG. 3 illustrates a top view of the laminated antenna of the first embodiment. FIG. 4 illustrates an exploded view of the laminated antenna of the first embodiment. Please refer to FIGS. 2 to 4. The laminated antenna comprises a base board 10, a feed-in portion 20, a dielectric layer 30, a conductive layer 40, and a second winding portion 50. The feed-in portion 20, the dielectric layer 30, and the conductive layer 40 are sequentially stacked on the base board 10. The second winding portion 50 is connected to the conductive layer 40. The conductive layer 40 comprises a main radiation portion 41, an extension radiation portion 42, and a first winding portion 43. The extension radiation portion 42 is connected to the main radiation portion 41 through the first winding portion 43. A housing 60 covers the feed-in portion 20, the dielectric layer 30, the conductive layer 40, and the second winding portion 50, and the housing 60 is assembled with the base board 10.

Please refer to FIGS. 3 and 4. The base board 10 comprises a grounding port 11 and a feed-in port 12. The grounding port 11 is for connected to a grounding layer (not shown) which supplies a grounding potential. The feed-in port 12 is for connecting to a high frequency circuit.

Figure 5:
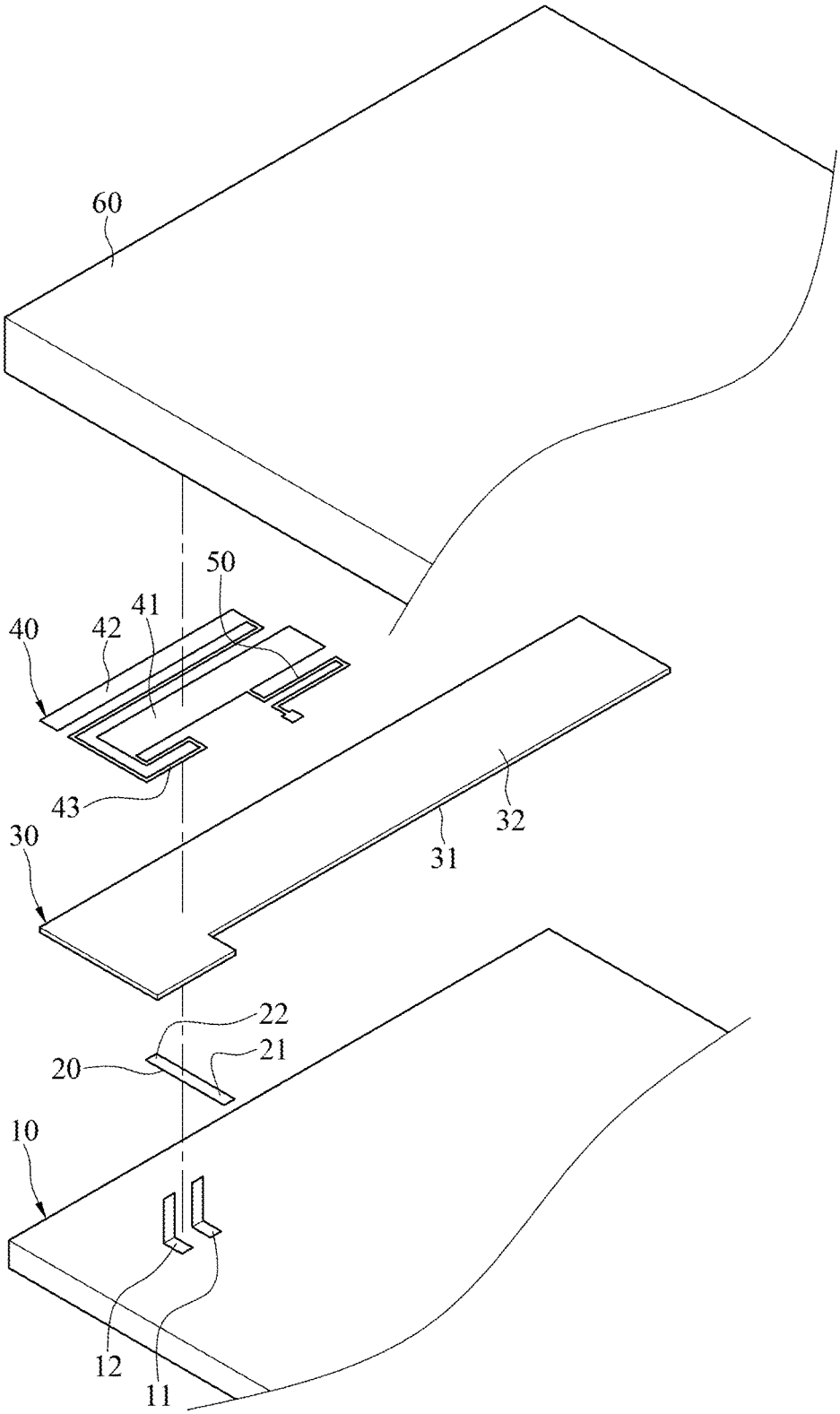
FIG. 5 illustrates an exploded view of another embodiment shown in FIG. 4.

FIG. 5 illustrates an exploded view of another embodiment shown in FIG. 4. Please refer to FIGS. 5. In this embodiment, one of two ends of the grounding port 11 and one of two ends of the feed-in port 12 are respectively on the base board 10, and the other end of the grounding port 11 and the other end of the feed-in port 12 are extending away from the base board 10 and respectively connected to the second winding portion 50 and a first end 21 of the feed-in portion 20. In one embodiment, the other end of the grounding port 11 (i.e., the end of the grounding port 11 distant from the base board 10) and the other end of the feed-in port 12 (i.e., the end of the feed-in port 12 distant from the base board 10) are substantially vertical to the base board 10, but embodiments are not limited thereto.

The feed-in portion 20 is covered by the dielectric layer 30. The feed-in portion 20 has a first end 21 and a second end 22 opposite to the first end 21. The first end 21 is connected to the feed-in port 12. The second end 22 is spaced from the conductive layer 40 by the dielectric layer 30, and the second end 22 interacts with the conductive layer 40 to form a coupling capacitor. The dielectric layer 30 has a covering surface 31 and an assembling surface 32 opposite to the covering surface 31. The covering surface 31 covers the feed-in portion 32. The assembling surface 32 is for configuring the conductive layer 40 thereon. Wherein, an interval is between the covering surface 31 and the assembling surface 32 of the dielectric layer 30 to correspond to the value of the coupling capacitor. In other words, the value of the coupling capacitor formed by the interaction between the second end 22 and the conductive layer 40 is related to the interval, and the value can be adjusted accordingly, but embodiments are not limited thereto.

In one embodiment, the feed-in portion 20 may be made of conductive metal materials, but embodiments are not limited thereto. Alternatively, the feed-in portion 20 may be made of nonmetal conductive materials.

In one embodiment, the dielectric layer 30 may be made of insulated materials, such as plastics, ceramics, or the like, but embodiments are not limited thereto.

The main radiation portion 41, the extension radiation portion 42, and the first winding portion 43 are respectively on the assembling surface 32. The main radiation portion 41 is of elongate shape. The first winding portion 43 is extending, toward a direction away from the extension radiation portion 42, from one end of the main radiation portion 41, and extending backward to pass through a section between the main radiation portion 41 and the extension radiation portion 42 so as to extend to the extension radiation portion 42. Moreover, the main radiation portion 41 comprise a portion 411 overlapped with the second end 22 of the feed-in portion 20. In other words, from a top view of the conductive layer 40, the portion 411 is completely overlapped with the second end 22 of the feed-in portion 20 (as shown in FIG. 3). Therefore, the portion 411, the dielectric layer 30, and the second end 22 in layer structures can be interact with each other to form the coupling capacitor. In one embodiment, the portion 411 is between a connection portion of the first winding portion 43 and the main radiation portion 41 and a connection portion of the second winding portion 50 and the main radiation portion 41. It is understood that, the length of the second end 22 is not limited by the embodiments.

The value of the coupling capacitor is related to the overlapped area between the portion and the second end, but embodiments are not limited thereto.

In one embodiment, the first winding portion 43 may be a conductive metal, and the first winding portion 43 is on the assembling surface 32 of the dielectric layer 30. The first winding portion 43 may have a bent portion to from a first inductor, but embodiments are not limited thereto. In some embodiments, the first winding portion 43 may have several bent portions so as to form a first inductor with larger value (compared with the case of one bent portion). It is understood that, the value of the first inductor and the number of the bent portion are not limited by the embodiments.

Figure 6:
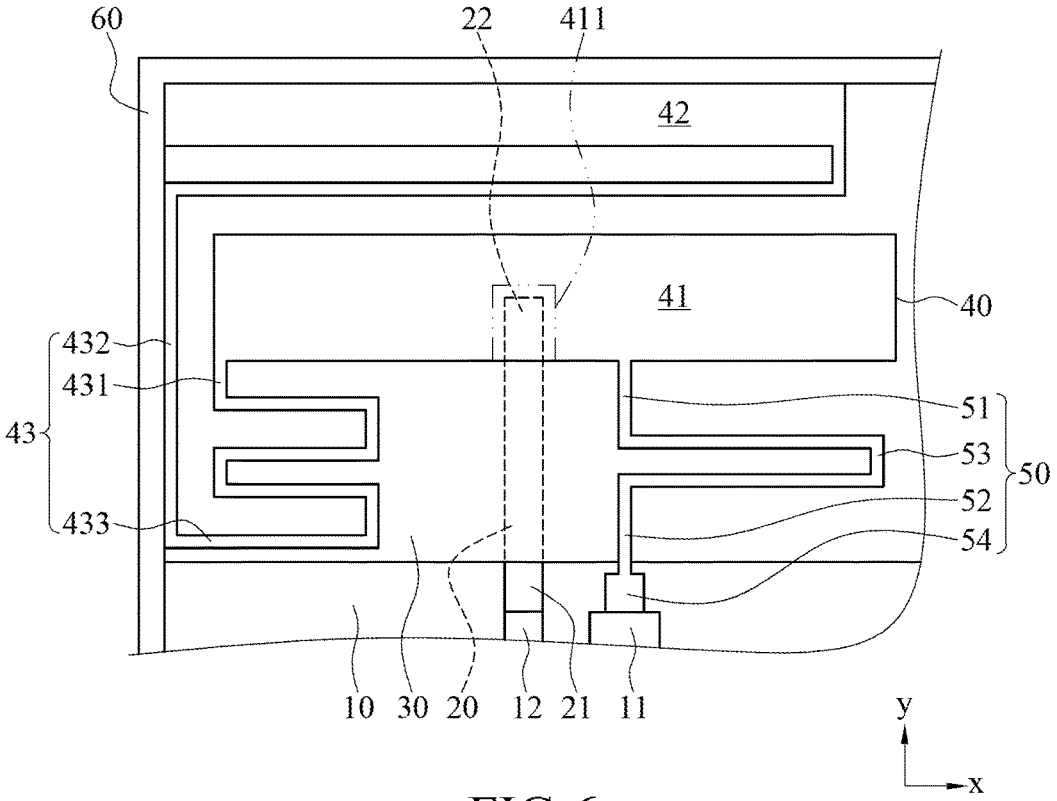
FIG. 6 illustrates a top view of a laminated antenna according to a second embodiment of the instant disclosure.

FIG. 6 illustrates a top view of a laminated antenna according to a second embodiment of the instant disclosure. Please refer to FIGS. 3 and 6. The first winding portion 43 comprises a first end 431, a second end 432, and a first sensing portion 433 between the first end 431 and the second end 432. One of two ends of the first end 431 is extending to the main radiation portion 41. The other end of the first end 431 is extending along a first direction (as the +X direction shown in FIG. 3) by a first distance, then extending along a second direction (as the −Y direction shown in FIG. 3) vertical to the first direction by a second distance, followed by extending along a direction opposite to the first direction (as the −X direction shown in FIG. 3) by the first distance, so that the first end 431 is extending to the second end 432. Accordingly, the bent portion having C-like shape can be formed between the first end 431 and the second end 432, and the first inductor can be formed. Please refer to FIG. 6. When the other end of the first end 431 further repeats the extending configuration, several bent portions may be formed between the first end 431 and the second end 432, so that the first winding portion has C shape and reverse C shape structures alternately arranged with each other. Therefore, the value of the first inductor can be adjusted. Wherein, the first direction and the second direction are not limited to the X and Y directions shown in FIG. 3. The value of the first distance and that of the second distance are not limited by the embodiments.

The extension radiation portion 42 is extending to the first winding portion 43. Accordingly, the first inductor and the coupling capacitor are interacted to form an oscillator, so that the extension radiation portion 42 generates a first frequency band corresponding to the oscillator.

Figure 7:
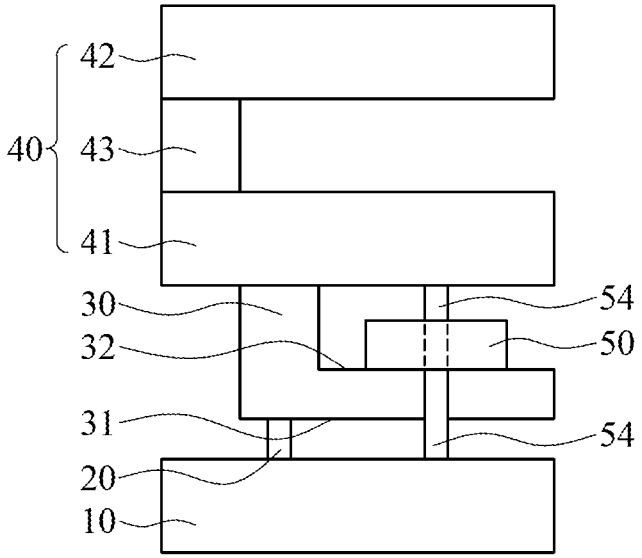
FIG. 7 illustrates a sectional view of another embodiment shown in FIG. 6.
Figure 8:
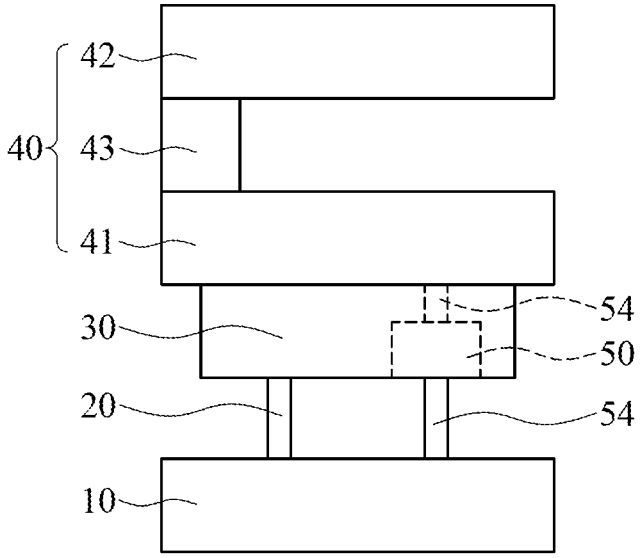
FIG. 8 illustrates a sectional view of yet another embodiment shown in FIG. 6.

FIG. 7 illustrates a sectional view of another embodiment shown in FIG. 6. FIG. 8 illustrates a sectional view of yet another embodiment shown in FIG. 6. Please refer to FIGS. 3, 7, and 8. The second winding portion 50 comprises a first end 51, a second end 52, and a second sensing portion 53 between the first end 51 and the second end 52. The first end 51 is connected between the main radiation portion 41 of the conductive layer 40 and the second sensing portion 53. The second end is connected between the grounding port 11 of the base board 10 and the second sensing portion 53. In one embodiment, the second winding portion 50 may be on the assembling surface 32 (as shown in FIG. 7), and the second end 52 is connected to the grounding port 11 through a connecting wire 54, but embodiments are not limited thereto. Alternatively, the second winding portion 50 may be on the base board 10 (as shown in FIG. 2) and connected to the conductive layer 40 through the connecting wire 54. In a further option, the second winding portion 50 may be in the dielectric layer 30 (as shown in FIG. 8); that is, the second winding portion 50 passes through the dielectric layer 30, the first end 51 is connected to the conductive layer 40 through the connecting wire 54, and the second end 52 is connected to the grounding port 11 through another connecting wire. Accordingly, the second sensing portion 53 of the second winding portion 50 can have similar bent portion(s) to form a second inductor.

Wherein, at least one of the first inductor and the second inductor form an oscillator with the coupling capacitor. That is, the first inductor and the coupling capacitor can generate an oscillator, the second inductor and the coupling capacitor can generate an oscillator, or the first inductor, the second inductor, and the coupling capacitor can generate an oscillator. Accordingly, the antenna can be operated in multiband.

Figure 9:
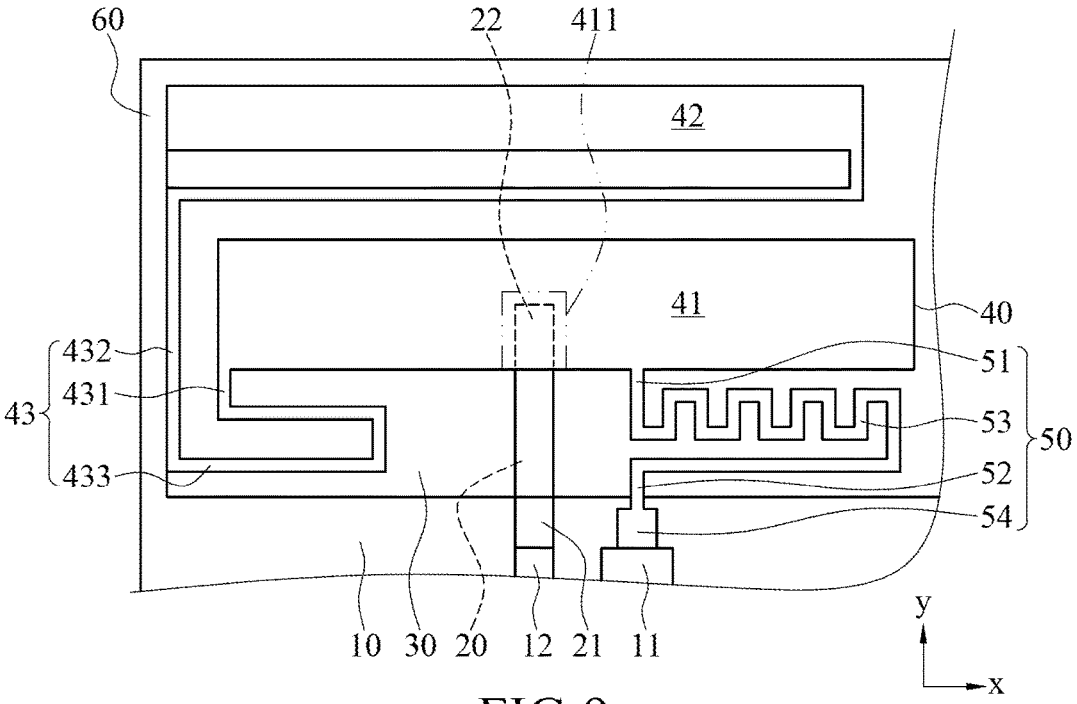
FIG. 9 illustrates a top view of a laminated antenna according to a third embodiment of the instant disclosure.

FIG. 9 illustrates a top view of a laminated antenna according to a third embodiment of the instant disclosure. Please refer to FIG. 9. Similar to the first winding portion 43, an end of the first end 51 (which is distant from the conductive layer 40) is extending along the first direction (i.e., the +X direction) by a first distance, next extending along the second direction (i.e., the +Y direction) by a second distance, then extending along the first direction by the first distance again, followed by extending along a direction opposite to the second direction (i.e., the −Y direction) by the second distance, so that the second sensing portion 53 can be formed, and the second end 52 is connected to the grounding port 11. Moreover, when the second sensing portion 53 has repeated extending configurations, the second sensing portion 53 can have several C shaped bent portions, and the overall length of the second sensing portion 53 can increase. Accordingly, the size of the second sensing portion 53 can be adjusted according to different needs.

Wherein, for the second sensing portion 53, the first direction and the second direction are not limited to the X and Y directions shown in FIG. 9. The value of the first distance and that of the second distance are not limited by the embodiments.

Figure 10:
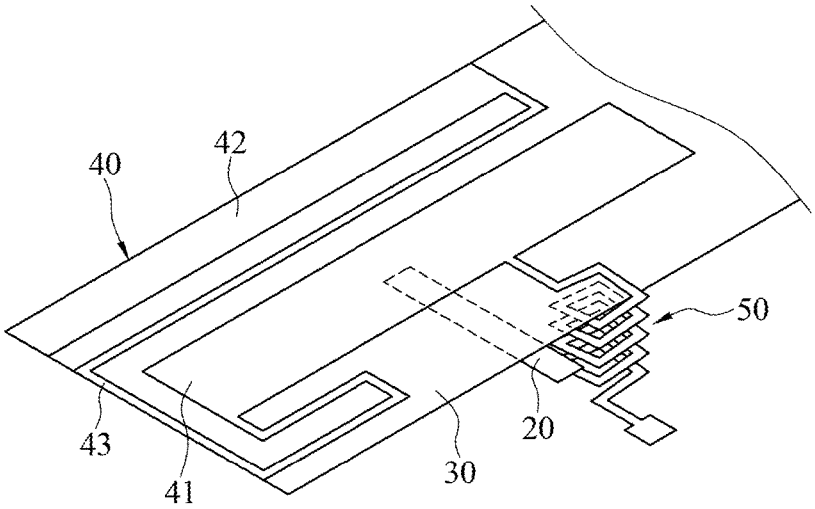
FIG. 10 illustrates a schematic view of a laminated antenna according to a fourth embodiment of the instant disclosure.
Figure 11:
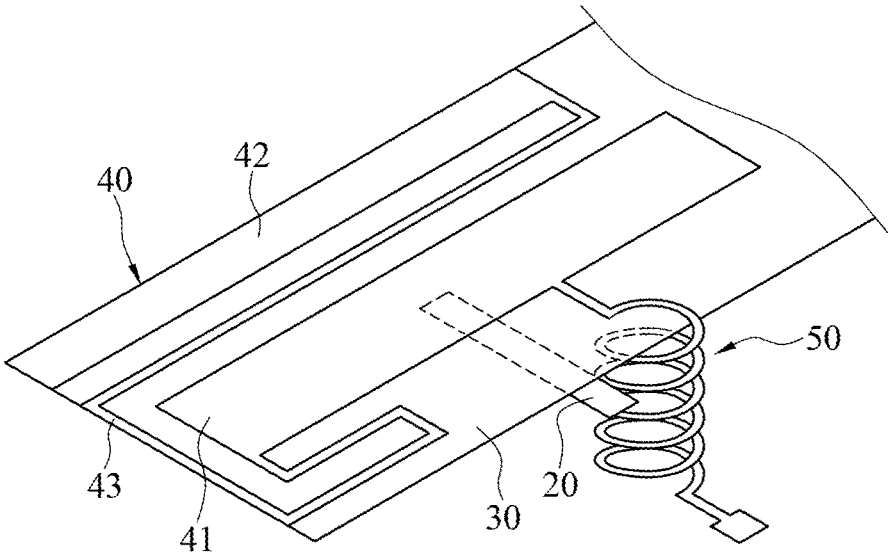
FIG. 11 illustrates a schematic view of another embodiment shown in FIG. 10.

FIG. 10 illustrates a schematic view of a laminated antenna according to a fourth embodiment of the instant disclosure. FIG. 11 illustrates a schematic view of another embodiment shown in FIG. 10. In this embodiment, the configuration of the first winding portion 43 is similar to that of the second winding portion 50. Please refer to FIGS. 9 and 11. The second sensing portion 53 of the second winding portion 50 is of spiral-like shape. The spiral shape may be a rectangular spiral shape, a circular spiral shape, or other spiral-like shapes, but embodiments are not limited thereto. Moreover, the first winding portion 43 may be of spiral-like shape as well. Furthermore, the first winding portion 43 may pass through the dielectric layer 30 as the second winding portion 50, but embodiments are not limited thereto.

Figure 12:
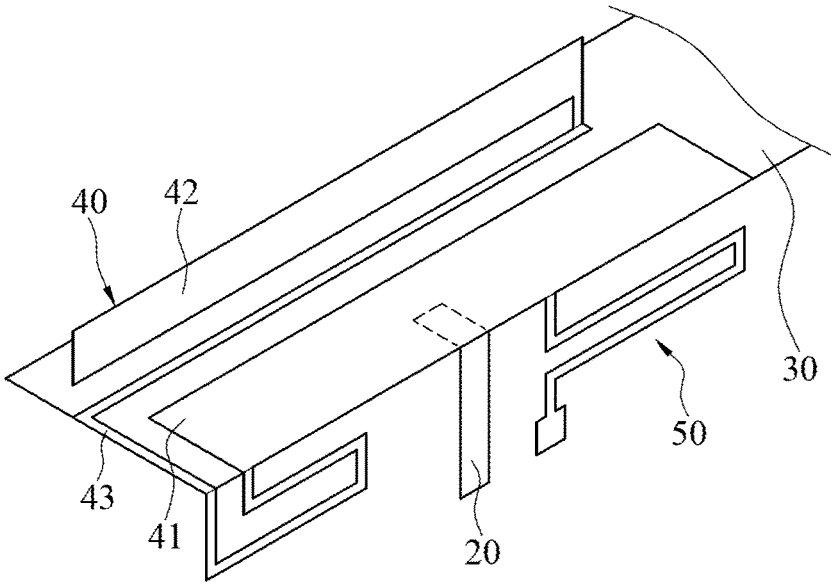
FIG. 12 illustrates a schematic view of a laminated antenna according to a fifth embodiment of the instant disclosure.
Figure 13:
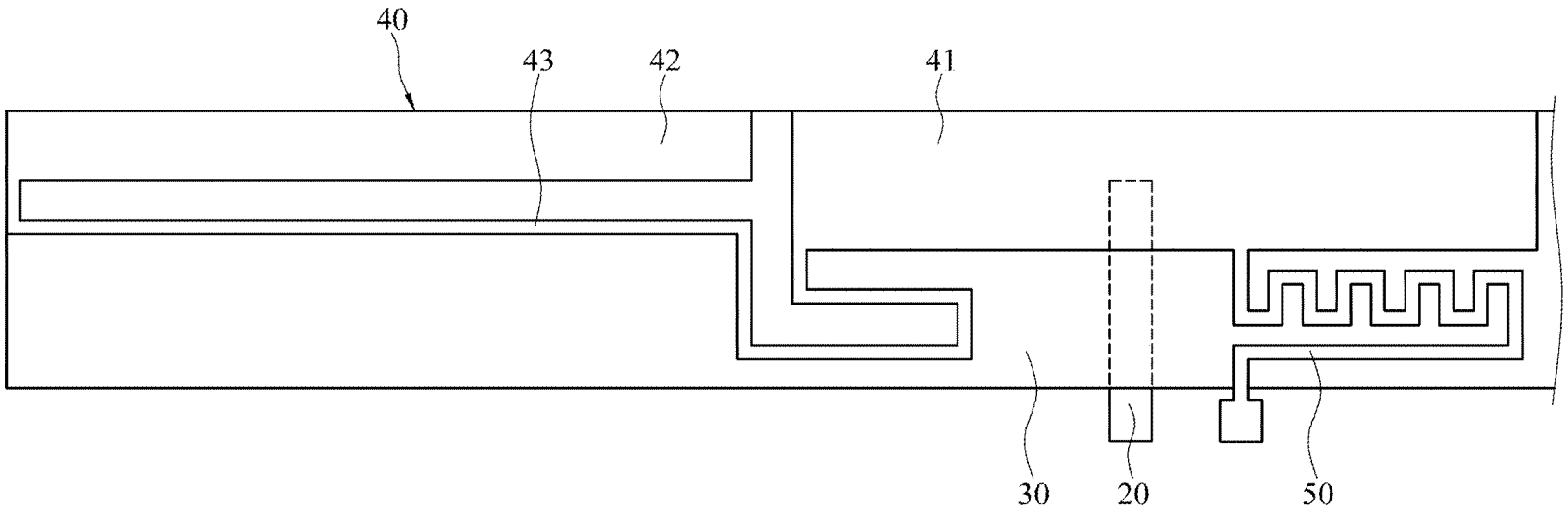
FIG. 13 illustrates a schematic view of a laminated antenna according to a sixth embodiment of the instant disclosure.

FIG. 12 illustrates a schematic view of a laminated antenna according to a fifth embodiment of the instant disclosure. FIG. 13 illustrates a schematic view of a laminated antenna according to a sixth embodiment of the instant disclosure. Please refer to FIG. 12. In this embodiment, the feed-in portion 20 may be respectively vertical to the dielectric layer 30, the conductive layer 40, and the second winding portion 50. Accordingly, the laminated antenna may have a three dimensional structure to fit the base board 10 and the housing 60, and the applications of the laminated antenna can be widened. Please refer to FIG. 13. In this embodiment, the extension radiation portion 42 of the conductive layer 40 is extending along a horizontal direction of the main radiation portion 41; i.e., the extension radiation portion 42 is at a left side of the main radiation portion 41 as shown in FIG. 13. Likewise, the extension radiation portion 42 may be at a right side of the main radiation portion 41, but embodiments are not limited thereto. In other words, the structures and the positions of the feed-in portion 20, the dielectric layer 30, the conductive layer 40, and the second winding portion 50 may be adjusted to fit the base board 10 and/or the housing 60 so as to meet different needs.

Based on the above, the laminated antenna can generate several bandwidths by the interactions of the coupling capacitor and the inductors. Therefore, the occupied area of the antenna can be reduced. Moreover, the overlapped area between the feed-in portion and the conductive layer can be changed to adjust the capacitance of the coupling capacitor. Hence, the bandwidth of the antenna can be adjusted accordingly. Consequently, the laminated antenna allows the capacitance and the inductance to be adjustable in a wider range. Therefore, the bandwidth of the antenna can be increased.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A laminated antenna, comprising:

a base board having a grounding port and a feed-in port;

a feed-in portion on the base board, wherein the feed-in portion has a first end and a second end opposite to the first end, the first end is connected to the feed-in port;

a dielectric layer covering on the feed-in portion, wherein the dielectric layer has a covering surface and an assembling surface opposite to the covering surface, the covering surface is near to the feed-in portion, and the assembling surface is distant from the feed-in portion;

a conductive layer on the assembling surface of the dielectric layer, wherein the conductive layer comprises:

a main radiation portion, wherein a segment of the main radiation portion is overlapped with the second end of the feed-in portion to form a coupling capacitor;

an extension radiation portion; and a first winding portion extending between the main radiation portion and the extension radiation portion to form a first inductor; and a second winding portion connected between the main radiation portion and the grounding port to form a second inductor.

2. The laminated antenna according to claim 1, wherein the segment of the main radiation portion is between a connection portion of the first winding portion with the main radiation portion and a connection portion of the second winding portion with the main radiation portion.

3. The laminated antenna according to claim 1, wherein one of two ends of the second winding portion which is near to the main radiation portion is on the assembling surface, and the other end of the second winding portion which is distant from the main radiation portion is on the base board.

4. The laminated antenna according to claim 3, wherein the second winding portion passes through the dielectric layer.

5. The laminated antenna according to claim 4, wherein the second winding portion is of spiral-like shape.

6. The laminated antenna according to claim 4, wherein the second winding portion has at least one bent portion.

7. The laminated antenna according to claim 3, wherein the second winding portion is of spiral-like shape.

8. The laminated antenna according to claim 3, wherein the second winding portion has at least one bent portion.

9. The laminated antenna according to claim 1, wherein the first winding portion is on the assembling surface.

10. The laminated antenna according to claim 9, wherein the first winding portion is of spiral-like shape.

11. The laminated antenna according to claim 9, wherein the first winding portion has at least one bent portion.

12. The laminated antenna according to claim 1, wherein at least one of the first inductor and the second inductor form an oscillator with the coupling capacitor.

13. The laminated antenna according to claim 1, wherein the main radiation portion is of elongate shape, and wherein the first winding portion is extending, toward a direction away from the extension radiation portion, from one end of the main radiation portion, bending, and extending backward to pass through a section between the main radiation portion and the extension radiation portion so as to extend to the extension radiation portion.

* * * * *